United States Patent [19]

Smith

[11] 4,076,630

[45] Feb. 28, 1978

[54] EMULSIFIERS FOR DURABLE FLAME RETARDANT TEXTILE FINISHES

[75] Inventor: Ray E. Smith, Ann Arbor, Mich.

[73] Assignee: Velsicol Chemical Corporation, Chicago, Ill.

[21] Appl. No.: 711,771

[22] Filed: Aug. 5, 1976

[51] Int. Cl.[2] ..... B27K 3/00

[52] U.S. Cl. ..... 252/8.1; 106/15 FP; 427/394

[58] Field of Search ..... 252/8.1; 106/15 FP; 117/136

[56] References Cited

U.S. PATENT DOCUMENTS 3,932,478 1/1976 Fenyes et al. ..... 252/8.1 X

*Primary Examiner*—Stephen J. Lechert, Jr.

*Attorney, Agent, or Firm*—Robert M. Phipps

[57] ABSTRACT

The use of haloalkyl phosphoric acids and their salts as emulsifiers for tris-haloaliphatic phosphates in aqueous systems is disclosed. The aqueous emulsions are useful as durable flame retardant textile finishes.

45 Claims, No Drawings

EMULSIFIERS FOR DURABLE FLAME RETARDANT TEXTILE FINISHES

BACKGROUND OF THE INVENTION

1. Field of the Invention

This invention pertains to the use of halogenated alkyl phosphoric acid salts as emulsifiers for tris-haloaliphatic phosphates and the use of these emulsified phosphates as durable flame retardant finishes for textile materials.

2. Description of the Prior Art

Recent years have witnessed a great interest in and a growing demand for flame retardant textiles and fabrics. Conventional methods and procedures for imparting flame retardant properties to many normally flammable materials involve impregnating or otherwise treating the particular material with an aqueous solution containing a flame retarding agent to be followed by a drying operation, usually at elevated temperatures. The difficulties encountered heretofore have dealt with the choice of the particular flame retarding agent. The reason for this is that most good flame retardants are not miscible or compatible with water. Many of the well known flame retarding agents are organic compounds containing phosphorus or halogen and often do not lend themselves to form aqueous solutions. But in order to take advantage of the excellent flame retardancy provided by these compounds it was necessary to solubilize them in suitable organic solvents and apply the resulting compositions to the fabric to be treated. Not only has this procedure been expensive, but in many cases, the solvent affected the fabric adversely, especially in the presence of certain dyes or other additives in the fabric. Furthermore, solvent recovery and application with its attendant capital expenditures and the limited number of suitable organic solvents have made non-aqueous systems very undesirable. Conversely, use of aqueous compositions provides fewer and less serious problems from a technological point in addition to economic advantages. In effect, flame retardant aqueous compositions can be applied to the desired fabric by relatively simple operations such as exhaust technique, or pad dry cure and the like.

In U.S. Pat. No. 3,729,434 there is disclosed a method of producing fire retardant emulsions by dissolving a halo alkyl phosphate in a substantially water immiscible organic solvent and an oil soluble, metal sulfonate/-polyoxyethylene ether blend. It is said that this system will form a stable aqueous emulsion.

U.S. Pat. No. 3,660,582 discloses the use of mono- and bishaloalkyl esters of phosphoric acid, their water soluble salts and mixtures thereof or an aqueous emulsion of such acids and salts or of the corresponding tris compounds as a topically applied flame retardant for melt spun polyester material.

More recently, there have been developed some flame retardant finishes for textiles which are successful even when applied to various cotton/polyester blends. Again these finishes use brominated flame retardants, the most common of which is tris(2,3-dibromopropyl)-phosphate. This material possesses good heat and hydrolytic stability. However, it is highly insoluble in water. Therefore, these finishes as well as other finishes previously proposed in the prior art utilize one or more emulsifiers which are necessary to maintain a workable emulsion that contribute nothing to the primary function of the composition or finish, i.e., flame retardancy.

There has now been discovered an emulsifier for the foregoing successful flame retardant finishes which is non-interfering with and can further contribute to the flame retardant efficacy of the textile finish.

SUMMARY OF THE INVENTION

In accordance with this invention there is provided an aqueous tris-haloaliphatic phosphate emulsion wherein the emulsifier for said tris-haloaliphatic phosphate is a water soluble mono- or bis-haloalkyl ester of phosphoric acid or a salt thereof.

DESCRIPTION OF THE PREFERRED EMBODIMENTS

The emulsifiers of this invention are the water soluble mono- and bis-haloalkyl esters of phosphoric acids, the water soluble salts and said acids, and mixtures thereof. The preferred emulsifiers are the haloalkyl phosphoric acid salts.

The preferred halo alkyl phosphoric acid salt emulsifiers of this invention are salts of bis(polyhaloalkyl)-phosphoric acid wherein each alkyl group is independently selected and is either a normal or branched chain alkyl group containing from 1 to 8 carbon atoms and from 1 to 8 halogen atoms. The halogen atom can be chlorine, bromine, or mixtures thereof. It is within the contemplation of this invention that one or both of the alkyl groups can be branched chain such as isopropyl, neopentyl, 2-ethylhexyl, tertiary butyl and the like. Preferably each alkyl group will contain from 1 to 6 carbon atoms and from 1 to 4 halogen atoms. The cation of the salt is selected from the group consisting of ammonium, amine, alkali metal of column I (i.e., lithium, sodium, potassium, and rubidium) and alkaline earth metal of column II (i.e., magnesium, calcium, strontium and barium) of the Periodic Table. The amine cations or salts useful in the invention are the so-called simple amines, such as pyridine, and mono-, di- and tri-alkyl amines and mono- and di-alkyl aromatic amines of 1 to 6 carbon atoms in each alkyl group and the corresponding hydroxyl amines, in each instance the alkyl group can be branched or normal. Suitable amines include monoethanol amine, diethanol amine, isopropyl amine, dipropyl amine, hexyl amine, triethyl amine, tributyl amine, and N,N-dimethyl aniline. Preferably, the cation is selected from the group consisting of ammonium, sodium, potassium, calcium or magnesium. With respect to cations of column II of the Periodic Table, the emulsifiers of this invention can be the salt of either one or two molecules of haloalkyl phosphoric acid.

Exemplary of the emulsifiers useful in this invention are ammonium bis(2,3-dibromopropyl)phosphate; potassium 2,3-dibromopropyl-3-bormo-2,2-bis(bromomethyl)propyl phosphate; sodium 2,3-dibromopropyl-3-bromo-2,2-bis(methyl)propyl phosphate; ammonium 2,3-dibromopropyl-3-chloro-bis(bromomethyl)propyl phosphate; potassium 2,3-dichloropropyl-3-chloro-2,2-bis(methyl)propyl phosphate; sodium bis(2,3-dichloropropyl)phosphate; calcium di(bis(2,3-dibromopropyl)-phosphate); calcium 2,3-dibromopropyl phosphate; magnesium di(bis(chlorobromopropyl)phosphate); isopropyl ammonium 2,3-dibromopropyl phosphate, diethanol amine bis(1,3-dibromoisopropyl)phosphate; diammonium 2,3-dibromopropyl phosphate; diammonium 1,3-dibromoisopropyl phosphate; 2,3-dibromopropyl phosphoric acid; bis(2,3-dibromopropyl)phosphoric acid; 1,3-dibromoisopropyl phosphoric acid; bis(1,3-dibromoisopropyl)phosphoric acid.

Two or more of the emulsifying agents may be used together, such as two different salts of a bis halopropyl ester of phosphoric acid; a salt of bis halopropyl ester of phosphoric acid and a salt of a mono-halopropyl ester of phosphoric acid; a salt of monohalopropyl ester of phosphoric acid and haloalkyl mono- or bis-acid ester of phosphoric acid; and a salt of bis-halopropyl ester of phosphoric acid and haloalkyl mono- or bis-acid ester of phosphoric acid.

The flame retardants emulsified by the emulsifiers of this invention are tris-haloaliphatic phosphates wherein each aliphatic group contains from 1 to 12 carbon atoms and preferably from 1 to 6 carbon atoms. Preferably the haloaliphatic group is a haloalkyl in either the normal or branched chain configuration. The halogen of the haloaliphatic group is preferably chlorine, bromine, or mixtures thereof when the aliphatic group contains more than one halogen atom. Each haloaliphatic group contains from 1 to 8, and preferably from 2 to 4, halogen atoms. Illustrative of the haloaliphatic phosphates utilized in the flame retardant finishes disclosed herein are tris(bromomethyl)phosphate; tris(2-chloroethyl)phosphate, tris(2,3-dibromopropyl)phosphate; bis(2,3-dibromopropyl) 2-chloroethyl phosphate; bis(bromopropyl)chloroethyl phosphate; bis(2,3-dibromopropyl)-3-bromo-2,2-bis(bromomethyl)propyl phosphate; bis(2,3-dibromopropyl)-3-bromo-2,2-bis(methyl)propyl phosphate; bis(2,3-dibromopropyl)-3-chloro-2,2-bis(-bromomethyl)propyl phosphate, bis(2,3-dibromopropyl)-2-chloro-2,2-bis(chloromethyl)propyl phosphate; bis(2,3-dibromopropyl)-3-chloro-2,2-bis(methyl)-propyl phosphate; bis(2,3-dichloropropyl)-3-chloro-2,2-bis(ethyl)propyl phosphate; tris(hexachlorooctyl)phosphate; tris(decabromododecyl)phosphate; bis(pentachlorohexyl)dibromopropyl phosphate; tris(1-bromo-3-chloroisopropyl)phosphate and tris(2-bromoethyl)-phosphate.

The flame retarding tris haloaliphatic esters of phosphoric acid are especially difficult to formulate in aqueous compositions. These esters are generally not water soluble and do not form an effective aqueous solution. Therefore, it is necessary to utilize an emulsion. Unfortunately, these compounds are also rather difficult to formulate into aqueous emulsions which are stable enough to be useful even when a wide variety of emulsifying agents has been tried. According to the present invention an emulsion forming concentrate can be produced by mixing the flame retardant ester in the water soluble emulsifiers described above. The concentrate is stable and is suitable in forming a stable aqueous emulsion. It should be noted that since the emulsion is aqueous in character the difficulties and hazards attendant upon the use of an alcohol or some other organic solvent are avoided.

In one embodiment of the present invention there is provided a stable concentrate for use in making a fire retardant aqueous emulsion for treating flammable materials and fabrics such as cellulosic, man-made and natural, exemplified by cotton, rayon and sisal; polyester; polyester/cotton; nylon, acrylic; and di- and tri-acetate. The concentrate comprises (i) a flame retardant tris-haloaliphatic phosphate, and (ii) an emulsifying agent selected from a water soluble haloalkyl mono- or bis- ester of phosphoric acid, a water soluble salt of said acid, or mixtures thereof. The concentrate may contain only one tris-haloaliphatic phosphate or a mixture of two, or even more, tris-haloaliphatic phosphates. Thus, in effect, the concentrate contains at least one tris-haloaliphatic phosphate flame retardant. Likewise, the emulsifier component of the concentrate may consist of only a single water soluble haloalkyl mono- or bis- ester of phosphoric acid; a mixture of two or more haloalkyl mono- or bis- esters of phosphoric acid; only one water soluble salt of mono- or bis-haloalkyl ester of phosphoric acid; a mixture of two or more of said salts; or a mixture of one or more of said salts with one or more of said acids.

The concentrate is formulated by mixing together the fire retardant phosphate tri-esters with the aforedescribed emulsifying agent. The concentrate should contain at least about 1 part by weight of emulsifier about every 10 parts by weight of flame retardant. This ratio of 1:10 is necessary in order to form a stable aqueous emulsion of the concentrate. If less emulsifying agent is present, the resultant emulsion is rather unstable. The upper limit of the concentration of emulsifier in the concentrate should be about 10 parts weight of the emulsifying agent for about 1 part by weight of the flame retardant. If the amount of flame retardant present in the concentrate falls below this ratio, the efficacy of the resultant finish for textiles as a flame retardant generally decreases to an unsatisfactory level.

A preferred weight ratio of the emulsifier to the flame retardant is from about 1:4 to about 4:1, with a more preferred ratio being from about 3:7 to about 7:3, and a ratio of from about 2:3 to about 3:2 being most preferred.

Another embodiment of the present invention is an aqueous tris-haloaliphatic phosphate emulsion wherein the emulsifier for said phosphate is a water soluble mono- or bis-haloalkyl ester of phosphoric acid, a water soluble salt of said acid, and mixtures thereof. This emulsion may be either an emulsion concentrate i.e., one which contains relatively large proportions of (i) flame retardant and (ii) emulsifier, and relatively small proportions of (iii) water; or it can be in a form ready for application, i.e., a flame retardant finish which contains relatively small proportions of (i) flame retardant and (ii) emulsifying agent, and relatively large proportions of (iii) water. The emulsion concentrate is stable and is particularly useful for shipping purposes. The emulsion concentrate is produced by mixing the aforedescribed concentrate with water under agitation. Alternately, the emulsion concentrate may be produced by adding the flame retardant tris-haloaliphatic phosphates to an aqueous solution of the mono- or bis-haloalkyl ester of phosphoric acid, its salt, or mixtures thereof. Generally the emulsion concentrate can contain, by weight percent, from about 8% to about 72% of the emulsifier, from about 10% to about 90% of the tris-haloaliphatic phosphate, and from about 2% to about 18% of water; preferably from about 16% to about 64% of the emulsifier, from about 20% to about 80% of the tris-haloaliphatic phosphate, and from about 4% to about 16% of water; and more preferably from about 24% to about 50% of the emulsifier, from about 30% to about 70% of the tris-haloaliphatic phosphate, and from about 6% to about 14% water. It is to be understood that more water can be added to the emulsion concentrate than that amount recited above. This will, of course, result in a correspondingly diluted emulsion concentrate. Generally, it is preferred that the amount of water in the emulsion concentrate not exceed 60% by weight of the emulsion concentrate.

The emulsion or aqueous flame retardant finish in its ready to use state may be formed by mixing either the concentrate or the emulsion concentrate with water under agitation. The amount of the (i) flame retardant and (ii) emulsifying agent used may differ quite a bit and, in fact, may vary from about 0.1% to about 60% by weight of the emulsion of aqueous flame retardant finish, preferably from about 0.2% to about 45%, and more preferably from about 0.2% to about 35%.

The emulsions of the present invention may be applied to the material being treated very easily in any appropriate manner while using conventional equipment. For example, spraying, dipping or padding methods and apparatus may be utilized. Suitable rollers may be used to remove excessive solution or emulsion depending upon the particular material being treated and the type of equipment which is available.

The following examples are presented by way of further illustration of the invention and should not be construed as limiting. All parts and percentages including those in the examples are by weight unless otherwise indicated.

EXAMPLE 1

The magnesium salt of bis-(2,3-dibromopropyl)phosphoric acid was prepared by mixing 75 grams of a 35 weight percent magnesium acetate solution with 750 grams of a solution containing 80%, by weight, of the ammonium salt of bis-(2,3-dibromopropyl) phosphoric acid. The resultant reaction mixture was heated to 60° to 80° C. with stirring. This resulted in a wet solid, 25 gms of which was dissolved in 3,500 gms of water at 60° C. The resultant solution was clear.

EXAMPLE 2

An 85% potassium salt of bis-(2,3-dibromopropyl) phosphoric acid was prepared by slowly adding 285 gms of KOH pellets to 335 gms of water with periodic cooling in an ice bath. 131 gms of this aqueous KOH solution was added to 493 gms of bis-(2,3-dibromopropyl) phosphoric acid. The resultant reaction product weighed 624 gms and contained approximately an 85% solution of the potassium salt of bis-(2,3-dibromoprpopyl) phosphoric acid.

EXAMPLE 3

An emulsion concentrate of the potassium salt of bis-(2,3-dibromopropyl) phosphoric acid and tris-(2,3-dibromopropyl) phosphate was formed by mixing 357 gms of the reaction product from Example 2 with 238 gms of tris-(2,3-dibromopropyl) phosphate at room temperature. The resultant emulsion concentrate weighed 595 gms.

EXAMPLE 4

An emulsion containing the potassium salt of bis-(2,3-dibromopropyl) phosphoric acid and tris-(2,3-dibromopropyl) phosphate was formed by adding 25 gms of the emulsion concentrate from Example 2 to 975 gms of water with stirring at room temperature.

EXAMPLE 5

An 80% sodium salt of bis-(2,3-dibromopropyl) phosphoric acid was prepared by mixing 230 gms of 25.4% aqueous sodium hydroxide to 1058 gms of bis-(2,3-dibromopropyl) phosphoric acid slowly with stirring. The reaction mixture was cooled in an ice bath to about 25° C. After the exothermic reaction had substantially ceased 95 gms of water were added to obtain a solution containing approximately 20% $H_2O$.

EXAMPLE 6

An emulsion concentrate containing the sodium salt of bis-(2,3-dibromopropyl) phosphoric acid and tris-(2,3-dibromopropyl) phosphate was prepared by mixing at room temperature 768 gms of the 80% sodium salt of bis-(2,3-dibromopropyl) phosphoric acid prepared in Example 4 with 512 gms of tris-(2,3-dibromopropyl) phosphate.

EXAMPLE 7

An emulsion of the sodium salt of bis-(2,3-dibromopropyl) phosphoric acid, tris-(2,3-dibromopropyl) phosphate and water was prepared by mixing at room temperature 25 gms of the emulsion concentrate of Example 5 with 975 gms of water. 2.56 gms of a non-ionic wetting agent, specifically trimethyl nonanol ethoxylate, was added to the emulsion to improve the stability thereof.

EXAMPLE 8

The triethanolamine salt of bis-(2,3-dibromopropyl) phosphoric acid was prepared by mixing together 103 gms of bis-(2,3-dibromopropyl) phosphoric acid, 29 gms of water and 21 gms of triethanolamine and heating the reaction mixture to 60° C. The resultant aqueous solution of the triethanolamine salt of bis-(2,3-dibromopropyl) phosphoric acid was clear and light yellow in color with a pH of about 7 to 8.

EXAMPLE 9

An emulsion concentrate of the triethanolamine salt of bis-(2,3-dibromopropyl) phosphoric acid and tris-(2,3-dibromopropyl) phosphate was prepared by mixing at room temperature 115.5 gms of the aqueous solution from Example 8 with 77 gms of tris-(2,3-dibromopropyl) phosphate.

EXAMPLE 10

A 67% ammonium salt of bis-(2,3-dibromopropyl)-phosphoric acid was prepared as follows: 400 gms of bis-(2,3-dibromopropyl)phosphoric acid were dissolved in 100 gms of water; to this solution were added 100 gms of 28% $NH_4OH$. The resultant liquid was light yellow in color and had a pH of about 7.

EXAMPLE 11

To 70 gms of the ammonium salt of bis-(2,3-dibromopropyl)phosphoric acid of Example 10 were added 30 gms of tris-(2,3-dibromopropyl)phosphate and a clear emulsion concentrate was produced. This resultant emulsion contained about 23% water, 30% tris-(2,3-dibromopropyl)phosphate, and 48% ammonium bis-(2,3-dibromopropyl)phosphate.

EXAMPLE 12

33.3 gms of the emulsion concentrate from Example 11 were added to 966.7 gms of water with stirring until a stable milky emulsion was formed which contained 1% of tris-2,3-dibromopropyl)phosphate. 2000 gms of additional water were added to this emulsion. Into this 3000 gm bath was introduced a piece of 100% spun polyester knitted fabric weighing 100 gms. At this point the fabric to liquor ratio was 1:30 and the emulsion contained 10 gms of tris-(2,3-dibromopropyl)phosphate or 10% based on the weight of the fabric. The temperature of the bath containing the fabric was raised to 205°-212° F. and the bath was agitated. As the temperature was increased the bath began to decrease in cloudiness, indicating an absorbtion of the tris-(2,3-dibromopropyl) by the polyester fiber. The bath was held at 200°-212° F., with agitation, for a period of about 2 hours. No foaming was observed. The fabric was removed from the bath, hand rinsed and tumble dried. Bromine counts were measured by the x-ray fluorescence spectrometric method using a General Electric XRD-5 spectrometer on the treated fabric and an untreated fabric. The bromine count of the untreated fabric was 49 and that of the treated fabric was 11,651. This confirmed the visual observation that the tris-(2,3-dibromopropyl)phosphate had been absorbed by the polyester fiber.

The treated fabric is usually cured by heating for a short period of time, usually from about 1 to 5 minutes, at temperatures of about 180° to about 210° C. The curing fixes the flame retardant in the fabric so that the fabric retains its flame retardancy even after repeated washings.

The method described in Example 12, known in the art as Atmospheric Exhaustion, is only one of the many methods by which the emulsions of the present invention may be applied to fabrics to impart flame retardancy thereto. Other techniques may also be used. Among the more common ones known in the art are the socalled Pressure Exhaustion method and the Pad Dry Cure method.

The Pressure Exhaustion method is generally similar to the Atmospheric Exhaustion method described above except that the bath containing the fabric is heated to higher temperatures, in the range of about 140° C., and is kept under superatmospheric pressures. With this method no curing step is needed to fix the flame retardant, i.e., the tris-haloaliphatic phosphate, to the fabric as the higher temperatures existent in the bath cause the phosphate to be fixed to the fabric.

These Exhaustion methods are very efficient in that substantially all, on the order of about 90% and even higher, of the tris-haloaliphatic phosphate is absorbed from the bath onto the fabric. The fact that the use of the emulsions of the present invention does not result in foaming is of particular importance in the Exhaustion methods, especially the Pressure Exhaustion method, of application of the flame retardant. The use of heretofore known emulsions of tris-haloaliphatic phosphates had resulted in foaming—due to the presence of various organic emulsifiers and surfactants necessary to form an emulsion of the water insoluble tris-haloaliphatic phosphate upon heating and/or agitation of the bath, thereby, presenting certain problems which require solution. The solution has been to add an anti-foaming agent to the emulsion. However, the anti-foaming agents have generally tended to somewhat adversely affect the application and retention of the flame retardant onto the fabric and interfere with the performance of the flame retardant.

In the Exhaustion method the bath contains a relatively low amount of the concentrate of the present invention, generally from about 0.1% to about 25%, with from about 0.2% to about 15% being preferred, and with from about 0.2% to about 10% being more preferred.

The flame retardant properties of a fabric treated with an aqueous flame retardant finish of the present invention and in accordance with the afore-described Atmospheric Exhaustion method is exemplified below.

EXAMPLE 13

Thirty lbs. of an emulsion concentrate was prepared by mixing 18 lbs. of 80% aqueous ammonium bis(2,3-dibromopropyl)phosphate, that is, 14.4 lbs. of solid ammonium bis(2,3-dibromopropyl)phosphate and 3.6 lbs. of water, with 12 lbs. of tris(2,3-dibromopropyl)phosphate. This 30 lbs. of emulsion concentrate was added to 500 lbs. of cold water and stirred to form a milky emulsion. To this emulsion is added an additional 4,500 lbs. of water and the resultant composition is stirred. Into this aqueous flame retardant finish were placed 240 lbs. of 100% polyester circular knitted polyester fabrics, Carter Style 9019 (light weight) which had previously been scoured for 15 minutes at 140° F., and rinsed twice. The bath was heated to 190° F. at about 1°-2° F./min. and kept at 190° F. for about 1 hour. The fabric was then removed from the bath, rinsed, dried and heat set. The treated fabric was put through 50 laundering cycles.

The flame retardancy of the fabric and the durability of the flame retardant treatment was evaluated using the procedures established by the "Standard for the Flammability of Children's Sleepwear", U.S. Department of Commerce FF 3-71 (DOC FF 3-71). The Char Length, in inches, of the treated fabric of Example 13 was 2.4 inches.

Another well known and often used method for treating fabrics with fire retardant aqueous emulsions, which can be used with the concentrate and emulsions of the present invention, is the Pad Dry Cure method. This method generally comprises the steps of (i) immersing the fabric into a fire retardant aqueous emulsion, (ii) squeezing out the fabric between rollers or the like to remove excess solution, (iii) drying the fabric to remove water, and (iv) curing or thermosoling the fabric with the fire retardant thereon to fix the fire retardant. When the compositions of the present invention are used in this method the aqueous emulsion or finish contains a relatively higher concentration of the concentrate of the present invention than that present with the Exhaustion method. The concentration of the tris haloaliphatic phosphate/mono- or bis- ester of phosphoric acid, or its salt, concentrate is generally from about 0.2% to about 35%, preferably from about 0.5% to about 25%, more preferably from about 1% to about 20%.

One of the surprising advantages of using the Pad Dry Cure method with the compositions of the present invention is that there appears to be a synergistic effect, as regards the amount of flame retardant deposited and retained on the fabric, obtained by using the emulsifier/-flame retardant of the present invention. The mono- and bis-haloalkyl acid esters of phosphoric acid and their water soluble salts are known fire-retarding agents. However, heretofore they have not been used as emulsifying agents for the tris-haloaliphatic phosphate flame retardants. When the flameretardant finishes of the present invention are applied to fabrics it has been found that more flame retardant is retained on the fibers than if the same quantity of either the mono- or bishaloalkyl acid esters of phosphoric acid and the salts thereof, or the tris-haloaliphatic phosphate had been used as the sole fire retardant.

This phenomenon can best be illustrated by the following examples.

EXAMPLE 14

Three woven 100% polyester fabrics were treated, respectively, with three different finishing solutions in accordance with the Pad-Dry-Cure method. The three finishing solutions contained, by weight percent, respectively, 15.4% of ammonium salt of bis-(2,3-dibromopropyl) phosphoric acid; 15.4% tris-(2,3-dibromopropyl) phosphate; a mixture of 8.4% of the ammonium salt of bis-(2,3-dibromopropyl) phosphoric acid and 7% of tris-(2,3-dibromopropyl) phosphate. The treated fabrics were then subjected to 50 launderings cycles. Portions of the fabrics treated with the respective finishing solutions were removed after drying, after curing, after washing, after 20 launderings, after 30 launderings, after 40 launderings, and after 50 launderings, and subjected to analysis to determine the bromine count by the x-ray fluorescence spectrometric method using a General Electric XRD-5 spectrometer. The results are set forth in Table I.

As can be seen from the data in Table I a fabric treated with a finishing solution containing both the salt of bis-(2,3-dibromopropyl) phosphoric acid and the tris-(2,3-dibromopropyl) phosphate has a higher bromine count than the fabrics treated with finishing solutions containing either the salt of bis-(2,3-dibromopropyl) phosphoric acid alone or tris-(2,3-dibromopropyl) phosphate alone. This difference in bromine counts, which is indicative of the relative amounts of the salt of bis-(2,3-dibromopropyl) phosphoric acid and the tris-(2,3-dibromorpopyl) phosphate retained by the fabric, becomes more marked as the treated fabric is exposed to an increasing amount of laundering cycles.

TABLE I

| Sample | Finishing Solution | Bromine Counts | | | | | | |
|---|---|---|---|---|---|---|---|---|
| | | After Dry | After Cure | After Wash | After 20 Launderings | After 30 Launderings | After 40 Launderings | After 50 Launderings |
| 1 | 15.4% ammonium salt of bis-(2,3-dibromopropyl) phosphoric acid | 12,330 | 12,757 | 8,914 | 6,781 | 6,805 | 6,474 | 7,410 |
| 2 | 15.4% tris-(2,3-dibromopropyl) phosphate | 11,368 | 11,977 | 10,573 | 7,960 | 7,494 | 7,392 | 6,969 |
| 3 | 8.4% ammonium salt of bis-(2,3-dibromopropyl) phosphoric acid and 7% of tris-(2,3-dibromopropyl) phosphate | 12,622 | 13,842 | 11,410 | 9,867 | 9,576 | 9,353 | 10,214 |

Although not completely understood, this phenomenon is believed to be due to the fact that the tris-(2,3-dibromopropyl) phosphate in some way affects the fibers of the fabric in such a manner that these fibers pick up and retain a greater amount of the salt of bis-(2,3-dibromopropyl) phosphoric acid than is normally the case when only the salt, without the tris-(2,3-dibromopropyl) phosphate is present.

The concentrates of the present invention can contain only (i) emulsifier or mixture of emulsifiers, and (ii) flame retardant, without any solvent, i.e., they may be solventless concentrates. Alternately, the concentrates may contain an amount of water which is normally present during the formation of the salts of the mono- or bis-haloalkyl phosphoric acid; or additional water may be introduced to make the concentrates less viscous. In either case, the concentrates which contain (i) emulsifier, (ii) flame retardant, and (iii) water are more properly considered emulsions. If a small amount of water is present, e.g., that amount normally present in the formation of the salt, they can be considered as emulsion concentrates. The emulsion concentrates can generally contain from about 1% to about 40%, by weight, of water, preferably from about 1% to about 30%, and more preferably from about 1% to about 20%.

The concentrates, emulsion concentrates, or emulsions or aqueous finishes may optionally have incorporated therein other additives commonly used or well known in the fabric treating art. Exemplary optional additives are dyes; wetting agents such as an anionic phosphate surfactant in free acid form, a nonionic nonylphenyl polyethylene glycol ether, and a nonionic polyethylene glycol ether of linear alcohol; buffering agents such as urea, and the like.

While the composition of the concentrates, emulsion concentrates, and emulsions or aqueous finishes may vary widely they must, nevertheless, be so constituted as to fulfill the following two criteria: (i) the composition must contain a flame retardant amount of the tris haloaliphatic phosphate, by flame retardant amount is meant an amount sufficient to render flammable materials and fabrics flame retardant when treated with the compositions containing said tris haloaliphatic phosphate; and (ii) the composition must contain an emulsifying amount of the emulsifier of the present invention, by emulsifying amount is meant an amount sufficient to form a stable aqueous emulsion of the tris haloaliphatic phosphate.

Based on this disclosure, many other modifications and ramifications will naturally suggest themselves to those skilled in the art. These are intended to be comprehended as within the scope of this invention.

The embodiments of the invention in which an exclusive property or privilege is claimed are defined as follows:

1. An aqueous tris-haloaliphatic phosphate emulsion concentrate wherein the emulsifier for said phosphate is a water soluble mono- or bis-haloalkyl ester of phosphoric acid, a water soluble salt of said acid and mixtures thereof, said water comprising from about 1 percent to about 40 percent by weight of the total concentrate.

2. The emulsion of claim 1 wherein said emulsifier is at least one water soluble salt of mono- or bis-haloalkyl ester of phosphoric acid.

3. The emulsion of claim 2 wherein said emulsifier is at least one water soluble salt of bis-haloalkyl ester of phosphoric acid.

4. The emulsion of claim 3 wherein said haloaliphatic radical contains from 1 to about 12 carbon atoms and from 1 to about 8 halogen atoms.

5. The emulsion of claim 4 wherein said haloaliphatic radical contains from 1 to 6 carbon atoms.

6. The emulsion of claim 4 wherein said haloaliphatic radical contains from 2 to 4 halogen atoms.

7. The emulsion of claim 6 wherein said halogen atoms are chlorine, bromine, and mixtures thereof.

8. The emulsion of claim 7 wherein said haloaliphatic radical is a haloalkyl radical.

9. The emulsion of claim 8 wherein said haloalkyl radical is dibromopropyl.

10. The emulsion of claim 9 wherein said salt is ammonium bis-(dibromopropyl) phosphate.

11. The emulsion of claim 3 wherein the cation of said salt is selected from the group consisting of ammonium, amine, alkali metals, alkaline earth metals, and mixtures thereof.

12. The emulsion of claim 11 wherein said haloalkyl radical contains from 1 to about 8 carbon atoms and from 1 to about 8 halogen atoms.

13. The emulsion of claim 12 wherein said haloalkyl radical contains from 1 to 6 carbon atoms and from 1 to 4 halogen atoms.

14. The emulsion of claim 13 wherein said halogen atom is chlorine, bromine, and mixtures thereof.

15. The emulsion of claim 14 wherein said cation is ammonium, potassium, or sodium.

16. The emulsion of claim 15 wherein said cation is ammonium.

17. The emulsion of claim 15 wherein said haloalkyl radical is dibromopropyl.

18. An aqueous flame retardant finish for textile materials comprising (a) a tris-haloaliphatic phosphate flame retardant, (b) water, and (c) an emulsifying amount of a water soluble mono- or bis-haloalkyl ester of phosphoric acid, a water soluble salt of said acid and mixtures thereof, said water comprising at least 40 percent by weight of said finish.

19. The finish of claim 18 wherein said emulsifier is at least one water soluble salt of mono- or bis-haloalkyl ester of phosphoric acid.

20. The finish of claim 19 wherein said emulsifier is at least one water soluble salt of bis-haloalkyl ester of phosphoric acid.

21. The finish of claim 20 wherein said haloaliphatic radical contains from 1 to about 12 carbon atoms and from 1 to about 8 halogen atoms.

22. The finish of claim 21 wherein said haloaliphatic radical contains from 1 to 6 carbon atoms and from 2 to 4 halogen atoms.

23. The finish of claim 21 wherein said halogen atom is chlorine, bromine, or mixtures thereof.

24. The finish of claim 23 wherein said haloaliphatic radical is a haloalkyl radical.

25. The finish of claim 24 wherein said haloalkyl radical is dibromopropyl.

26. The finish of claim 25 wherein said salt is ammonium bis-(dibromopropyl) phosphate.

27. The finish of claim 20 wherein the cation of said salt is selected from the group consisting of ammonium, amine, alkali metals, alkaline earth metals, and mixtures thereof.

28. The finish of claim 20 wherein said haloalkyl radical contains from 1 to about 8 carbon atoms and from 1 to about 8 halogen atoms.

29. The finish of claim 28 wherein said haloalkyl radical contains from 1 to 6 carbon atoms and from 1 to 4 halogen atoms.

30. The finish of claim 29 wherein said halogen atom is chlorine, bromine, or mixtures thereof.

31. The finish of claim 30 wherein said cation is ammonium, sodium, or potassium.

32. A concentrate for an aqueous flame retardant finish for textile materials comprising (i) a tris-haloaliphatic phosphate flame retardant, and (ii) an emulsifier selected from a mono- or bis-haloalkyl ester of phosphoric acid, a salt of said acid, and mixtures thereof.

33. The concentrate of claim 32 wherein said emulsifier is at least one salt of a mono- or bis-haloalkyl ester of phosphoric acid.

34. The concentrate of claim 33 wherein said emulsifier is at least one salt of a bis-haloalkyl ester of phosphoric acid.

35. The concentrate of claim 34 wherein the haloaliphatic radical contains from 1 to about 12 carbon atoms and from 1 to about 8 halogen atoms.

36. The concentrate of claim 35 wherein said haloaliphatic radical contains from 1 to 6 carbon atoms and from 2 to 4 halogen atoms.

37. The concentrate of claim 36 wherein said halogen is chlorine, bromine, or mixtures thereof.

38. The concentrate of claim 37 wherein said haliali-phatic radical is a haloalkyl.

39. The concentrate of claim 38 wherein said haloalkyl is dibromopropyl.

40. The concentrate of claim 39 wherein said salt is ammonium bis-(dibromopropyl) phosphate.

41. The concentrate of claim 33 wherein the cation of said salt is selected from ammonium, amine, alkali metals, alkaline earth metals, and mixtures thereof.

42. The concentrate of claim 41 wherein the haloalkyl radical contains from 1 to about 8 carbon atoms and from 1 to about 8 halogen atoms.

43. The concentrate of claim 42 wherein said haloalkyl radical contains from 1 to 6 carbon atoms and from 1 to 4 halogen atoms.

44. The concentrate of claim 42 wherein the halogen atom is chlorine, bromine, or mixtures thereof.

45. The concentrate of claim 44 wherein said cation is ammonium, sodium, or potassium.

* * * * *